US007792317B2

(12) United States Patent
Lin et al.

(10) Patent No.: US 7,792,317 B2
(45) Date of Patent: Sep. 7, 2010

(54) FLAT PANEL DISPLAY WITH DETACHABLE ANTI-VIBRATE SPEAKER

(75) Inventors: Wen-Pin Lin, Taipei County (TW); Kuan-Cheng Hsieh, Keelung (TW); Shih-Po Lo, Taipei County (TW); Yi-Chung Chiu, Taoyuan County (TW)

(73) Assignee: Hannspree, Inc., Taipei (TW)

( * ) Notice: Subject to any disclaimer, the term of this patent is extended or adjusted under 35 U.S.C. 154(b) by 1036 days.

(21) Appl. No.: 11/515,930

(22) Filed: Sep. 6, 2006

(65) Prior Publication Data

US 2007/0253590 A1 Nov. 1, 2007

(30) Foreign Application Priority Data

Apr. 28, 2006 (TW) ..... 95207242 U

(51) Int. Cl.

| | |
|---|---|
| ***H04R 1/02*** | (2006.01) |
| *H04R 5/02* | (2006.01) |
| *H04R 1/00* | (2006.01) |
| *H04R 9/06* | (2006.01) |
| *H04R 11/02* | (2006.01) |

(52) U.S. Cl. ..... 381/388; 381/87; 381/300; 381/306; 381/333; 381/386; 381/431

(58) Field of Classification Search ..... 381/388
See application file for complete search history.

(56) References Cited

U.S. PATENT DOCUMENTS 7,120,265 B2 * 10/2006 Sperle et al. ..... 381/306
7,242,785 B2 * 7/2007 McNary ..... 381/182

* cited by examiner

*Primary Examiner*—Curtis Kuntz
*Assistant Examiner*—Matthew Eason
(74) *Attorney, Agent, or Firm*—WPAT., P.C.; Justin King

(57) ABSTRACT

A flat panel display with detachable anti-vibrate speaker includes a speaker body with a front bezel attached at least one speaker driver, a rear bezel and a middle frame. The middle frame with a bottom positioning hole is made of an elastic material and situated between the front bezel and the rear bezel, and an elastic rib is formed on an inner surface of the middle frame to separate and to be against the front bezel and the rear bezel. A stand includes a positioning structure and a top surface groove. The positioning structure is assembled inside the top surface groove and is blocked by a blocking member fixed on an upper surface of the top surface groove. An elastic member is situated in the bottom of the top surface groove and a positioning member with a round top is located between the blocking member and the elastic member and is pushed to fit the positioning hole by the elastic member.

11 Claims, 4 Drawing Sheets

FLAT PANEL DISPLAY WITH DETACHABLE ANTI-VIBRATE SPEAKER

BACKGROUND OF THE INVENTION

1. Field of the Invention

The present invention relates to a detachable anti-vibrate speaker, and more particularly to a flat panel display with detachable anti-vibrate speaker.

2. Description of the Related Art

On the current market, the traditional flat panel display with attachable speaker are generally fixed by using screws, with this troublesome method a tool is needed such as a screw driver to unscrew the screws when the speakers are taken apart as well there is a great chance that the flat panel display or the speaker is damaged during the process.

Most of traditional speaker bodies are made out of wood or plastic material, when they are placed on the table or on flat surfaces they often need a rubber footing or stands for protecting both the speaker and the surface of the table. But the main reason for the rubber footing is to absorb the vibration that caused by the speaker driver.

It is a common problem that speaker experiences resonate caused by the speaker driver which can ruin the acoustics of the speaker, most common way of solving this problem is to place a rubber pad 80. Referring to FIG. 1, rubber pad 80 is screwed between a supporting member 60 and a speaker frame 70 to absorb the vibration, but this method is not very effective due to time consuming assembling process and high production cost.

SUMMARY OF THE INVENTION

The main object of this invention is to provide a flat panel display with detachable anti-vibrate speaker, comprising a speaker body and a stand. The speaker body comprises a front bezel being attached at least one speaker driver, a rear bezel and a middle frame, wherein the middle frame with a bottom positioning hole is made of an elastic material and situated between the front bezel and the rear bezel, an elastic rib is formed on an inner surface of the middle frame to separate and to be against the front bezel and the rear bezel. A stand includes a positioning structure and a top surface groove. The positioning structure is assembled inside the top surface groove and is blocked by a blocking member fixed on an upper surface of the top surface groove. The positioning structure comprises an elastic member situated in the bottom of the top surface groove, and a positioning member with a round top is clipped between the blocking member and the elastic member and is pushed to fit the positioning hole by the elastic member. With the combination of bottom positioning hole and the positioning structure it allows the easy attachment and detachment of the anti-vibrate speaker.

Furthermore, this invention provides a middle frame made of elastic material selected from the group consisting of silicon rubber (SR), nature rubber (NR), isoprene rubber (IR), styrene butadiene rubber (SBR), butadiene rubber (BR), polychloroprene rubber (CR), butyl rubber (IIR), nitrile rubber (NBR), ethylene propylene rubber (EPM) and ethylene propylenediene rubber (EPDM). Since the middle frame is formed in one piece, it provides the protection for both the speaker body and the flat panel display and with the elastic characteristic it reduces vibration caused by the speaker driver.

Another object of this invention is to effectively reduce resonate generated by the speaker driver and consequently improve the sound quality of the speaker by providing an elastic rib between the front and rear bezels.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

A flat panel display 10 with detachable anti-vibrate speaker according to an embodiment of the present invention comprises a speaker body 20 and a stand 30.

Figure 1:
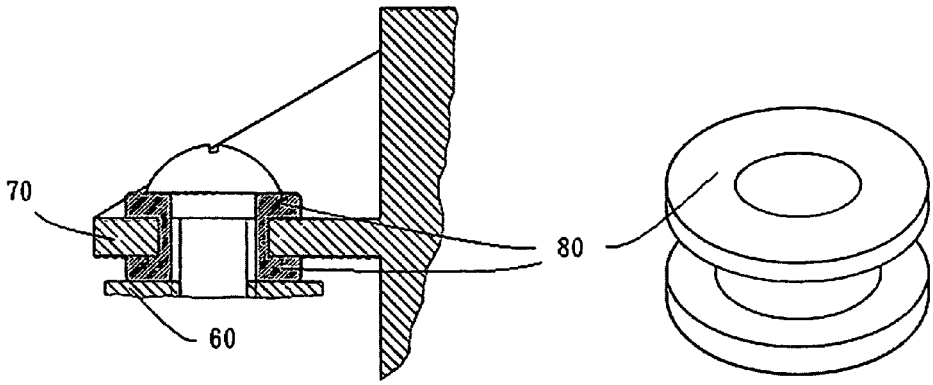
FIG 1. Prior Art
FIG. 1 is a sectional view of the conventional rubber pad for speaker.
Figure 2:
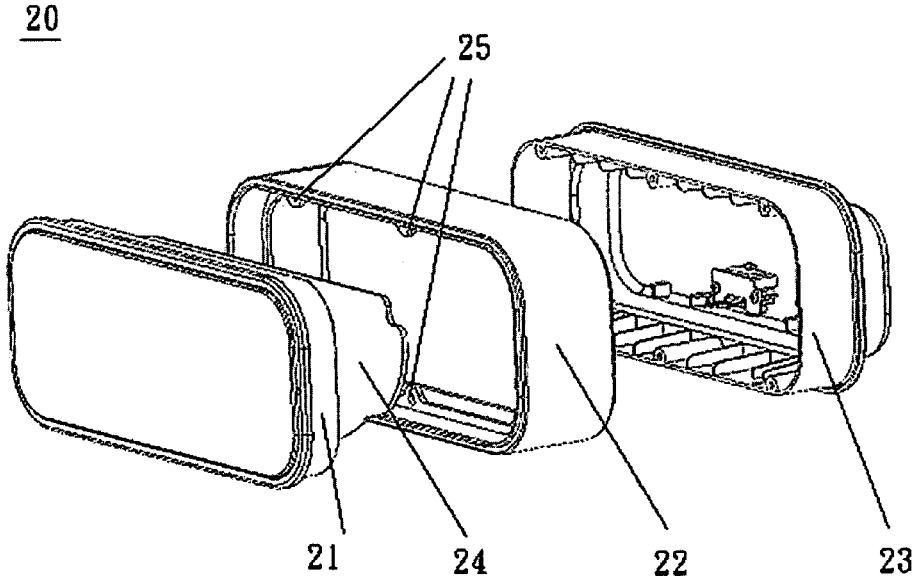
FIG. 2 is an exploded view of the detachable anti-vibrate speaker.
Figure 3:
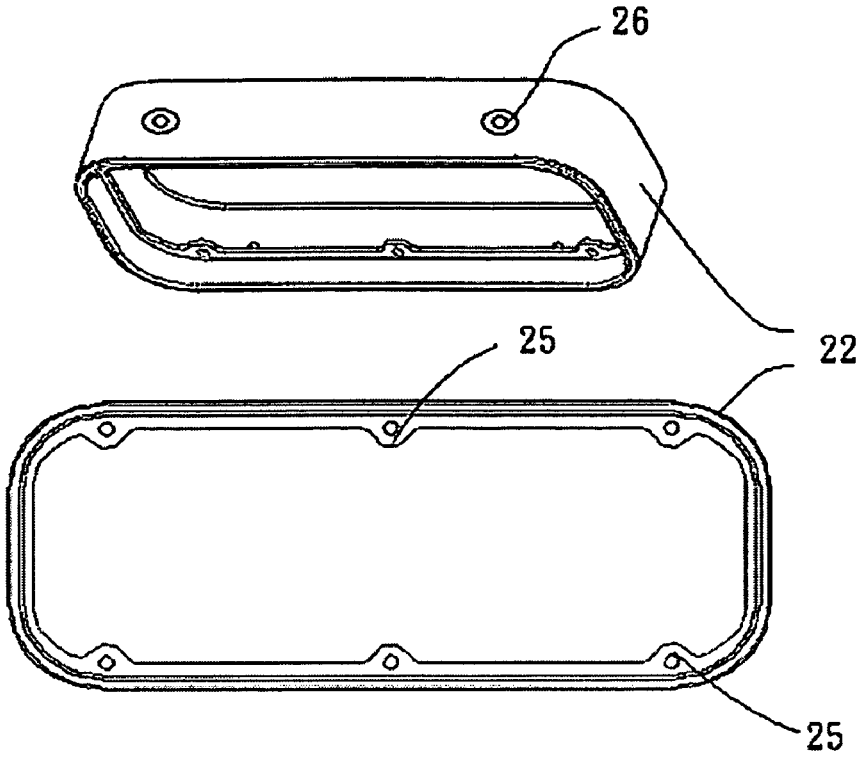
FIG. 3 is a perspective and side views of the middle frame.

Referring to FIG. 2, the speaker body 20 comprises a front bezel 21 attached a speaker driver 24, a rear bezel 23 and a middle frame 22, wherein the middle frame 22 with a bottom positioning hole 26 is made of an elastic material and situated between the front bezel 21 and the rear bezel 23. Referring to FIG. 3, a plurality of elastic ribs 25 are formed on an inner surface of the middle frame 22 to separate and to be against the front bezel 21 and the rear bezel 23. The middle frame 22 is made from elastic material, which is capable of absorbing vibration and resonate generated by the speaker driver 24. Furthermore, the middle frame 22 covers entire exterior of the speaker body 20, hence it provides complete protection for both the speaker body 20 and the surface of the table.

Figure 4:
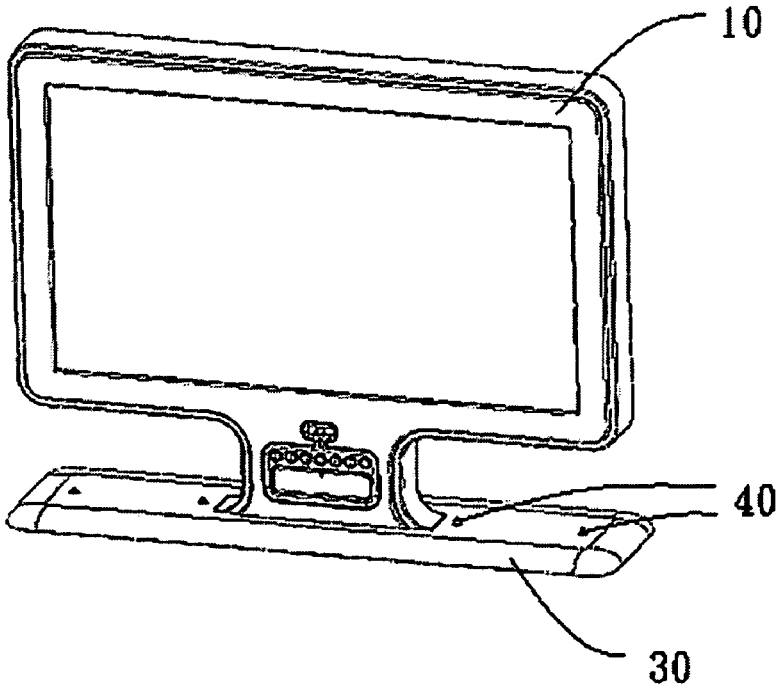
FIG. 4 is a perspective view of the flat panel display with the stand.
Figure 5:
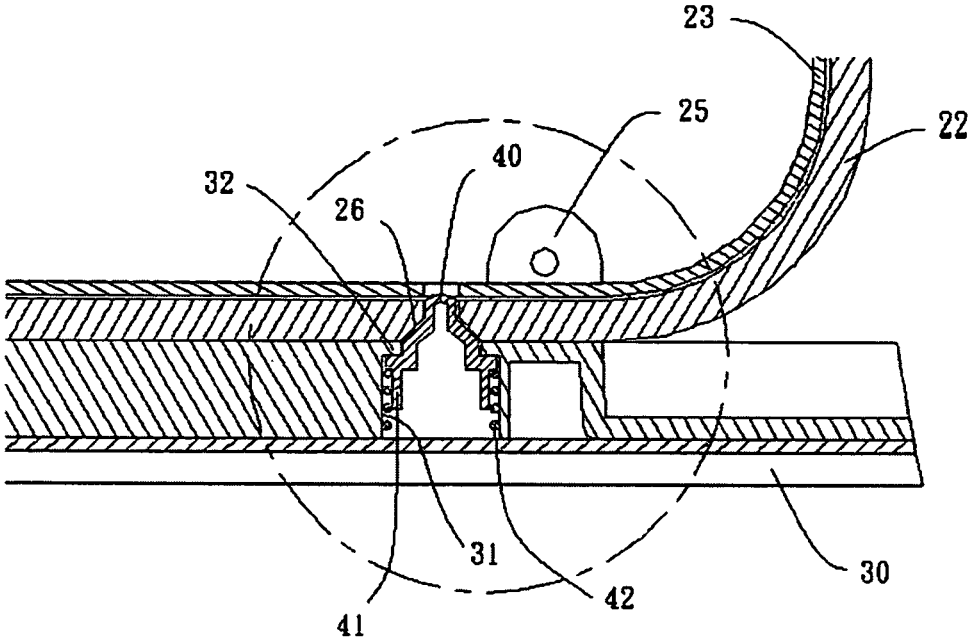
FIG. 5 is a sectional view of the positioning structure.

Referring to FIG. 4 and 5, the flat panel display 10 with the stand 30 includes a positioning structure 40 and a top surface groove 31. The positioning structure 40 is assembled inside the top surface groove 31 and is blocked by a blocking member 32 fixed on an upper surface of the top surface groove 31. The positioning structure 40 comprises an elastic member 42 situated in the bottom of the top surface groove 31, and a positioning member 41 with a round top is clipped between the blocking member 32 and the elastic member 42 and is pushed to fit the bottom positioning hole 26 by the elastic member 42.

According to this embodiment, six elastic ribs 25 are formed on the inner surface of the middle frame 22 and the entire middle frame 22 is made out of rubber as shown in FIG. 3. The number of elastic ribs 25 is not restricted; in this embodiment six elastic ribs 25 are sufficient to provide effective absorption and protection.

The elastic material of the middle frame 22 is not limited to rubber material. It can be selected from the group consisting of silicon rubber (SR), nature rubber (NR), isoprene rubber (IR), styrene butadiene rubber (SBR), butadiene rubber (BR), polychloroprene rubber (CR), butyl rubber (IIR), nitrile rubber (NBR), ethylene propylene rubber (EPM) and ethylene propylenediene rubber (EPDM).

In this embodiment, each speaker body 20 has two bottom positioning holes 26 designed as a concave hole and two positioning structures 40 in a form of convex shape with a pointy tip corresponding to each other, as shown in FIG. 3 and 4. However, depending on the design and size of the speaker body 20 and stand 30, the number and shape of the bottom positioning hole 26 and positioning structure 40 can vary.

Figure 6:
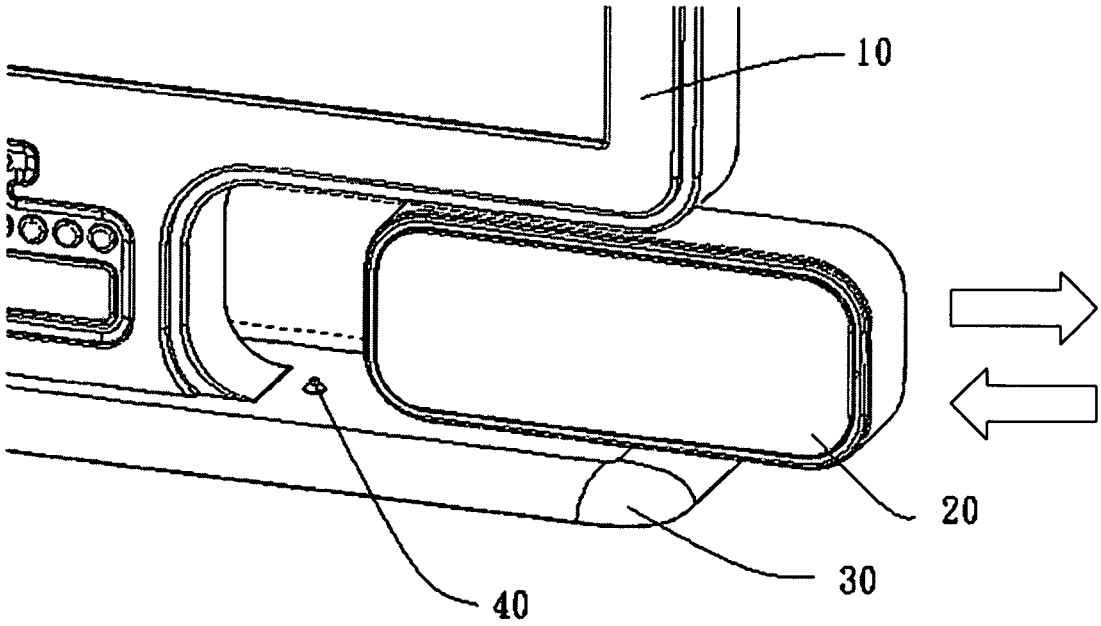
FIG. 6 is a schematic view of the flat panel display with detachable anti-vibrate speaker.

Referring to FIG. 6, the speaker body 20 can be simply detached or attached to the stand 30 by pulling or pushing on the speaker body 20. When detaching the speaker body 20, the pulling force forces the positioning structure 40 to compress the elastic member 42 inside the top surface groove 31. The positioning structure 40 then disengages from the bottom positioning hole 26, enabling the speaker body 20 to slide out of the stand 30 without use of any tools. In this embodiment the elastic member 42 is a spring.

Figure 7:
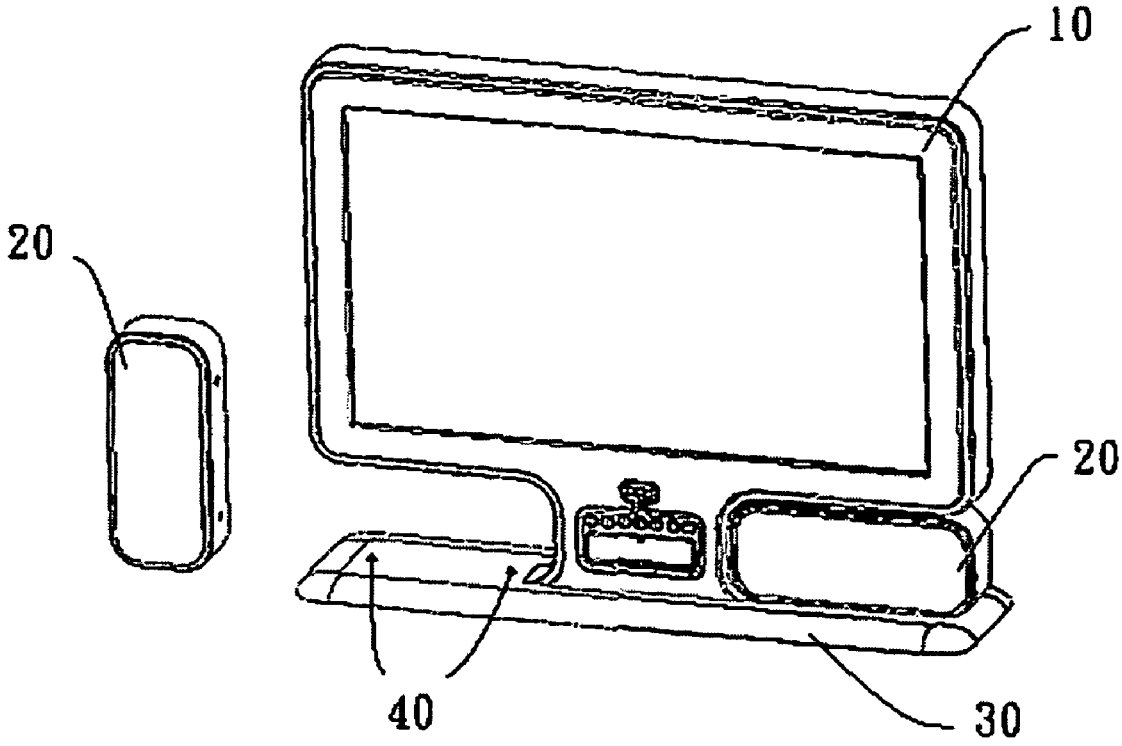
FIG. 7 is a perspective view of the present invention.

FIG. 7 illustrates the present invention, with one of the speaker body 20 fully detached from the flat panel display 10 and placed vertically on the side, and the other speaker body 20 attached to the stand 30. With the middle frame 22 protecting the entire speaker body 20, it allows the consumer to place the speaker body 20 on any kind of surfaces horizontally or vertically without causing any damages to the speaker body 20 or surface of the table.

This invention presents a simple mechanism that is provided an easy and simple way to detach or attach a speaker to flat panel display without the use of any tools. Specific design and use of elastic material absorbs the vibration and resonate, which produces a better and superb surround sound speaker. In addition, the speaker can be place on any surface or in any position, horizontally or vertically according to consumer's preference.

Various modifications in structure and/or function may be to the disclosed embodiments by one skilled in the art without departing from the scope of the invention as defined by the claims.

The invention claimed is:

1. A flat panel display with detachable anti-vibrate speaker, comprising:

a speaker body comprising a front bezel attached at least one speaker driver, a rear bezel and a middle frame, wherein the middle frame with a bottom positioning hole is made of an elastic material and situated between the front bezel and the rear bezel, and an elastic rib is formed on an inner surface of the middle frame to separate and to be against the front bezel and the rear bezel; and a stand including a positioning structure and a top surface groove, the positioning structure being assembled inside the top surface groove and being blocked by a blocking member fixed on an upper surface of the top surface groove, the positioning structure comprising:

an elastic member situated in a bottom of the top surface groove; and a positioning member with a round top clipped between the blocking member and the elastic member, and being pushed to fit the bottom positioning hole by the elastic member.

2. A flat panel display with detachable anti-vibrate speaker according to claim 1, wherein the elastic material is selected from the group consisting of silicon rubber, nature rubber, isoprene rubber, styrene butadiene rubber, butadiene rubber, polychloroprene rubber, butyl rubber, nitrile rubber, ethylene propylene rubber and ethylene propylenediene rubber.

3. A flat panel display with detachable anti-vibrate speaker according to claim 1, wherein the middle frame is formed in one piece.

4. A flat panel display with detachable anti-vibrate speaker according to claim 1, wherein the middle frame comprises a plurality of elastic ribs.

5. A flat panel display with detachable anti-vibrate speaker according to claim 1, wherein the bottom positioning hole is in form of a concave hole.

6. A flat panel display with detachable anti-vibrate speaker according to claim 1, wherein the middle frame comprises a plurality of bottom positioning holes.

7. A flat panel display with detachable anti-vibrate speaker according to claim 3, wherein the middle frame comprises a plurality of bottom positioning holes.

8. A flat panel display with detachable anti-vibrate speaker according to claim 4, wherein the middle frame comprises a plurality of bottom positioning holes.

9. A flat panel display with detachable anti-vibrate speaker according to claim 1, wherein the elastic member is a spring.

10. A flat panel display with detachable anti-vibrate speaker according to claim 1, wherein the positioning member is formed to have a convex shape with a pointy tip.

11. A flat panel display with detachable anti-vibrate speaker according to claim 1, wherein the stand comprises a plurality of positioning members.

* * * * *